US007916839B2

(12) United States Patent
Halazonetis et al.

(10) Patent No.: US 7,916,839 B2
(45) Date of Patent: Mar. 29, 2011

(54) COLLIMATOR

(75) Inventors: Thanos D. Halazonetis, Geneva (CH); Andre Liani, Hermance (CH); Nathan Jenkins, Geneva (CH); Juergen Brugger, Vufflens-la-Ville (CH); Kristopher Pataky, Renens (CH)

(73) Assignees: University De Geneva, Geneva (CH); Ecole Polytechnique Federal De Lausanne, Lausanne (CH)

( * ) Notice: Subject to any disclaimer, the term of this patent is extended or adjusted under 35 U.S.C. 154(b) by 54 days.

(21) Appl. No.: 12/425,947

(22) Filed: Apr. 17, 2009

(65) Prior Publication Data

US 2010/0014642 A1 Jan. 21, 2010

Related U.S. Application Data

(60) Provisional application No. 61/046,007, filed on Apr. 18, 2008.

(51) Int. Cl.
*G21K 1/02* (2006.01)

(52) U.S. Cl. ..... 378/147
(58) Field of Classification Search ..... 378/147–153
See application file for complete search history.

(56) References Cited

U.S. PATENT DOCUMENTS

| | | | | |
|---|---|---|---|---|
| 1,476,048 | A | 12/1923 | Bucky | |
| 5,771,270 | A | 6/1998 | Archer | |
| 7,462,854 | B2 * | 12/2008 | Pinchot | 250/506.1 |
| 2003/0223548 | A1 * | 12/2003 | Galish et al. | 378/147 |

OTHER PUBLICATIONS

Schultz et al., p53 binding protein 1 (53BP1) is an early participant in the cellular response to DNA double-strand breaks, Journal of Cell Biology, 2000, 1381-90, 151, Philadelphia.

* cited by examiner

*Primary Examiner* — Irakli Kiknadze
(74) *Attorney, Agent, or Firm* — Pepper Hamilton LLP

(57) ABSTRACT

The present invention is directed to a collimator that comprises grooves or channels in the submicrometer to micrometer range. The present invention is also related to uses of a collimator and collimator holder as described herein as well as apparatuses comprising the same.

25 Claims, 5 Drawing Sheets

COLLIMATOR

CROSS REFERENCE TO RELATED APPLICATIONS

The present application claims priority to U.S. Provisional Application No. 61/046,007, which is hereby incorporated by reference in its entirety.

BACKGROUND

Collimators are used to focus energy and in some embodiments X-rays, UV light, infrared light, and visible light. Additionally gamma radiation or other energy sources can also be collimated. Previous collimators have only been able to collimate energy sources using channels or grooves, whose dimensions are in the millimeter range. Examples of collimators, whose design was such that the width of the irradiated strips was in the millimeter range are found in U.S. Pat. Nos. 1,476,048 and 5,771,270. Accordingly, there is still a need for collimators whose collimation channels are in the submicrometer range or in the micrometer range to produce energy fields in the submicrometer range or in the micrometer range. The present invention fulfills this need as well as others.

SUMMARY OF THE INVENTION

In some embodiments, the present invention is directed to a collimator, a collimator holder and uses thereof including, but not limited to, apparatuses that include one or both components.

In some embodiments the present invention comprises a collimator and/or a collimator holder. A collimator collimates an X-ray beam so that its width can be limited, which in some embodiments the width is limited to the micrometer range. In some embodiments, the collimator holder holds the collimator and optionally includes an alignment apparatus and specimen holder to align the collimator to the X-ray beam and to hold the specimen, respectively.

In some embodiments, the present invention provides a collimator comprising at least one plate, wherein the plate comprises at least one groove, wherein the groove has a dimension that is in the submicrometer to micrometer range.

In some embodiments the collimator can be used to allow a specimen to be exposed to an X-ray field or fields, wherein the X-ray field or fields smallest dimension is in the submicrometer to micrometer range.

In some embodiments, the present invention provides an apparatus comprising a collimator holder and a collimator as described herein.

DETAILED DESCRIPTION

The collimator works on the principle of differential X-ray absorption. As X-rays travel through matter, their intensity is attenuated by a negative exponential coefficient. Different materials have different attenuation coefficients making it possible to create X-ray masks by combining them. The X-ray collimator described herein provides just such an X-ray contrast in order to collimate X-rays into patterns with micron and even sub-micron dimensions.

The collimator is designed, for example, for stripe irradiations, through stripe length and width may vary with application. Thus, in some embodiments, the collimator comprises a stack of flat x-ray absorbing chips, and some type of controlled spacer to separate them—producing paths along which x-rays can travel through the collimator stack.

Figure 1:
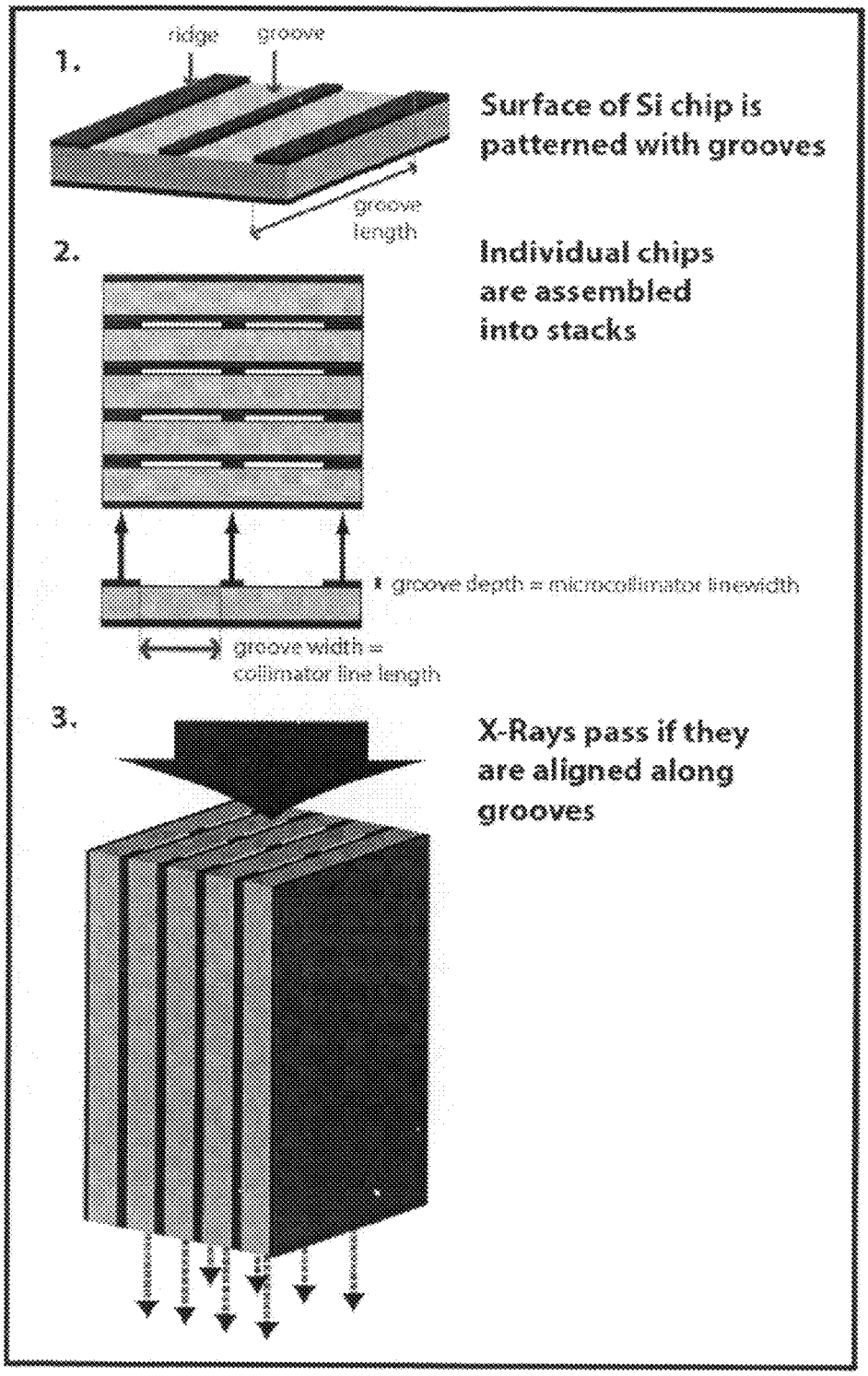
FIG. 1. Diagram showing silicon wafers (Si chips), which form the collimator when stacked against each other.

In some embodiments, the collimator comprises a stack of chips cut from standard Si, gallenium arsenide, and the like wafers used in microfabrication. The X-rays travel lengthwise down the stack along the planes of contact between the chips. X-ray contrast is provided by at least one groove running the length of the top of each chip. As the top side of one chip is placed against the bottom of another chip within the stack, the grooves provide channels for X-rays to pass unimpeded along the length of the stack. X-rays not aligned with the grooves are absorbed by the Si, gallenium arsenide, and the like chips resulting in collimation. The wafers can be polished on both sides so as to provide smooth surfaces for stacking and close contact. One example of such a collimator and how it can work in some embodiments is shown in FIG. 1.

The collimator can be constructed using any method that enables one to construct a collimator with grooves or channels in the submicrometer or micrometer range. In some embodiments the chips, which can be for example, but not limited to, Si chips, gallenium arsenide chips, and the like chips, used in the collimator are fabricated using standard microfabrication methods. In some embodiments, fabrication involves three steps: 1) Photolithography 2) Etching & 3) Dicing.

For example, in photolithography a polymer mask is photodefined into long strips on a Si wafer or a wafer made up of another material, such as gallenium arsenide and the like. The regions covered by the polymer will be protected from etching and will form ridges. The uncovered regions will be exposed to etching and will form the grooves. A complete layer of polymer is applied to the underside of the wafer to protect that surface during etching.

For example, in etching, the exposed surface of the wafer is attacked by chemical and/or physical means. The material is removed creating grooves. The depth of a groove and a channels that is formed when two chips are stacked (and hence the X-ray collimator line width) is defined by the amount of material etched. In some embodiments, the chips are coated with layers of Si02 or SiN by chemical vapor deposition (CVD). There are four advantages to using this technique. Firstly, these materials all have similar X-ray absorption coefficients. Second, CVD 10 processes produce thin films with a high degree of control over thickness ranging from tens of nanometers to several microns, and a high level of uniformity over a wafer's surface permitting many viable chips to be cut from one wafer. Thirdly, many etching systems exist offering a high degree of selectivity of Si02 or SiN over Si or gallenium arsenide resulting in groove-depth being controlled by film thickness rather than etching parameters. Finally, as CVD involves a gradual reaction of the Si or gallenium arsenide wafer itself the resulting films (the ridges and backsides of chips) and bottoms of the grooves (where the films are removed to expose Si or gallenium arsenide) are very smooth—ensuring good edge contrast within the collimator. The grooves can also be made by direct etching the surface of the Si or gallenium arsenide wafers themselves.

For example, in dicing, the wafer can be sectioned into chips by sawing. In some embodiments, chips can be 1 to 2 cm wide and 1 to 2 cm high. However, the chips can be made in nearly any dimensions provided the chips will fit on a Si or gallenium arsenide wafer and are large enough to be diced and assembled. Following dicing, the chips can be inspected and any showing defects which might interfere with the function of the collimator can be removed. The remaining polymer from the protective photomask can then be removed by an organic solvent. The chips can be rinsed in a weaker solvent and then sonicated in de-ionized water to remove residual solvent and dust particles. The chips can be dried under an N2 stream, cleaned by an oxygen plasma, and then can be finally be assembled in the collimator holder.

The collimators can be produced from double-side polished 4" (100 mm) diameter Si wafers or other wafers, such as gallenium arsenide, though nearly any microfabrication-compatible substrates can be used. The wafers can be 380 μm thick with a variance of ±10 μm. The thickness of the CVD films (when used) defines the groove depth (and hence X-ray collimator linewidth) and can be between 500 nm and 10 μm or, in some embodiments, up to and including 50 μm. This thickness can be varied over a large range, for example, from 10's of nanometers to several tens of microns if desired. When direct etching of the wafer is used to produce the grooves instead of etching a CVD layer, the grooves can be made 10's of nanometers to hundreds of micrometers in depth.

The groove width defines the collimator line length. In some embodiments, the groove width is not less than 50 μm to ensure a good probability of cutting across an entire cell spread on a surface (and irradiating its nucleus). The groove width can also be greater than 50 μm, including, but not limited to up to and including 3 mm wide. In some embodiments, the groove width can be 50-100, 50-500, 50-1000, 50-2000, or 50-3000 μm. Larger groove widths can leave the chips more prone to bending/deflection once subjected to a packing force inside the collimator holder. A greater number of ridges on a chip can reduce this bending but would require smaller groove widths.

The dimensions of the final Si or gallium arsenide chips are defined by the dimensions of the collimator holder. In some embodiments, chips of 1 cm width and 1 or 2 cm length have been used quite conveniently, however they can be made in nearly any size.

In addition to the sacrificial thin-film or direct etching methods presented above, there are various other ways by which collimators can be fabricated. Regarding the chips, nearly any x-ray absorbing material can be used so long as it is mechanically stable enough to be clamped. In some embodiments, the chips are those with uniform thickness and very flat surfaces. In addition to the chips presented here, other common semiconductor materials can be used for collimator because they actually attenuate x-rays to a higher degree than Si and can be micromachined as well. This includes, but is not limited to, the III-V semiconductors as well as other x-ray absorbing semiconducting compounds, such as, but not limited to, In, Ga, Ge, or combinations thereof. One such example is also, but not limited, to gallenium arsenide. These compounds are commonly used in microelectronics components specifically for x-ray applications (such as dosimeters and x-ray photography) for this very reason. Other materials which might conceivably be used as x-ray attenuating chips include ceramics and metallic plates though once again provided that they can be fabricated with a uniform thickness and possess uniform surfaces.

In some embodiments, there are two methods of producing spacers for the collimators: additive and subtractive processes. In subtractive processes, material is removed from either a sacrificial layer or from the x-ray attenuating chips themselves by various means. As described above, the etching of grooves into thin-films (Si02 or SiN) used as sacrificial layers on the wafers and the etching of grooves into native surface, such as Si or gallenium arsenide. In addition to etching, other means of micromachining could also be used to produce grooves along which x-rays can travel. These include, but are not limited to, laser machining (laser ablation) and conventional machining—for which a series of controlled cuts would be made along the surfaces of the x-ray attenuators to serve as grooves.

In additive processes, a spacer is basically built onto the x-ray attenuating chips and they are once again stacked. An example of such a process can be to use photoresist to structure spacers on one side of the chips. In this case, these polymeric spacers (ridges) are substantially transparent to x-rays as compared to the attenuating chips meaning that x-rays would be permitted to pass along the entire planes between the chips in the stack with minimal attenuation.

In some embodiments, the collimator described herein can be used to collimate X-rays, it can also be used to collimate other energy waves, including, for example, UV, visible and infrared light waves. Changes in the energy waves collimated may require changes in dimensions and materials used.

As described above, in some embodiments the collimator comprises silicon wafers with grooves, whose depth matches the desired width of the X-ray beam. The collimator is assembled by stacking silicon wafers and holding them against each other under pressure. In some embodiments, the collimator holder comprises two plates, which can be made out of, but not limited to, stainless steel or strong plastic or other suitable material) with the silicon wafers stacked between them. In some embodiments, the two plates can be incorporated within a larger holder that allows pressure to be exerted on the stack of silicon wafers using either screws or springs. By exerting pressure, one avoids the presence of air gaps between the silicon wafers and thus ensures that the width of the collimated X-ray beam corresponds to the depth of the grooves on the silicon wafers. In some embodiments, to ensure that no dust is trapped between the wafers (which would prevent the wafers from coming in close contact with each other) the silicon wafers can optionally be assembled into the holder, while being submerged in deionized water or ethanol.

The pattern of the collimated X-ray beam will depend on the patterns present in the silicon wafers that are assembled to form the collimator. The design of the collimator can, for example, place constraints on the patterns that can be generated. However, in some embodiments, the range of patterns can be enhanced by irradiating the specimen, then moving the specimen in a specified way and irradiating it again. For example, the specimen can be irradiated once, then rotated by 90 degrees and then irradiated again, thus creating cross-like patterns. Alternatively the specimen may be translated by a few microns (for example, by 100 microns), creating patterns that are more dense than the patterns that can be achieved with 380 micron-thick silicon wafers.

Figure 2:
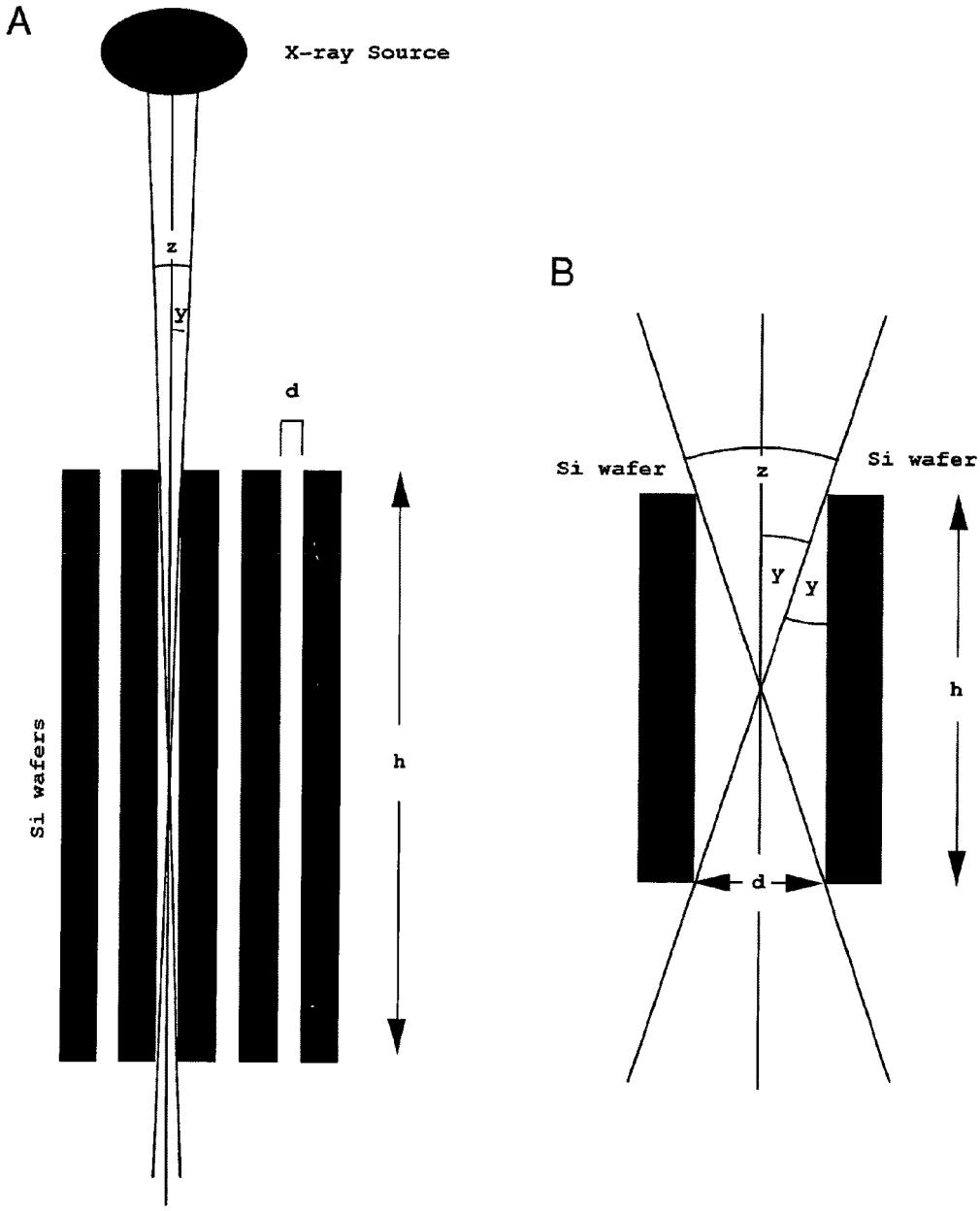
FIG. 2. Range of angles of X-ray beams relative to the collimator that can penetrate the collimator without being obstructed. For a microcollimator, whose height is h and whose depression depth is d, and assuming that h is much greater than d, then the angle y equals: $d \times 360/(2 \times pi \times h)$ degrees, where pi is about 3.14. For h=2 centimeters and d=1 micrometer, the angle y=0.0028 degrees and the angle z=0.0056 degrees. (A) View of the X-ray source and collimator. (B) Higher magnification view showing only two silicon wafers and the space between them. Both figures are not drawn to proportion for clarity.

The dimensions of the silicon wafers and the dimensions of the depressions on their surface can make it difficult to align the collimator to the X-ray beam. For example, in some embodiments for wafers that are 2 cm high and have grooves that are 1 micrometer deep, the X-rays beams that can penetrate the collimator without being obstructed must conform to an angle range of approximately 0.0056 degrees (See FIG. 2). If the X-ray beam that was being collimated consisted of X-rays that were entirely parallel to each other, then the collimator with the dimensions of the embodiment described above (2 cm high wafers with 1 micrometer deep grooves) would have to be aligned to the X-ray beam with an accuracy of ±0.0056 degrees, which can be difficult. X-rays emitted by most X-ray sources are not entirely parallel and this provides some leeway in the alignment of the collimator to the X-ray source. Nevertheless, the leeway may not be great and for this purpose the collimator holder can, optionally, incorporate an alignment apparatus.

There are many possible embodiments for alignment apparatuses. The basic principle is to allow the collimator holder to rotate along an axis that is perpendicular to the X-ray beam axis and also perpendicular to the shortest edge of the depression pattern in the silicon wafers (i.e. perpendicular to the depth of the groove). The rotation axis may pass through the center of the collimator or through its bottom edge or through other positions in space. In some embodiments, if the specimen to be irradiated is attached to the collimator holder and rotates with it, then the position of the rotation axis is not critical. In some embodiments, the rotation axis can be at the center of the X-ray beam, so that the distance of the collimator to the X-ray source does not change during alignment.

In some embodiments, the collimator can be rotated manually or remotely using a motor. In either case, the collimator can be rotated until the dose rate of X-rays passing through the collimator, which can be measured with an X-ray dosimeter, is maximized. In some embodiments, another possibility that essentially eliminates the need for adjustment is to use the motorized version of the alignment apparatus and program a slow rotation of the collimator over an angle range from about −2 degrees to about +2 degrees relative to the X-ray beam. This ensures that the correct alignment of the collimator relative to the X-ray beam is attained at some point during the rotation. Accordingly, the X-ray dose that the specimen receives can be controlled by varying the speed of rotation with slower rotation speeds leading to higher X-ray doses.

In some embodiments, the collimator holder can also optionally incorporate a specimen holder. If the alignment apparatus described above is also incorporated, then the specimen holder can rotate together with the collimator holder to ensure that the collimated X-rays always target the same area of the specimen during its rotation. In some embodiments, the specimen can be positioned to be as close as to the collimator as possible. However, because the X-rays passing through the collimator are essentially parallel to each other (with a divergence angle of about 0.0056 degrees for a collimator consisting of wafers that are 2 cm high and have 1 micrometer deep depressions), the specimen, in some embodiments, can be positioned at a distance of a few mm from the edge of the collimator. The design of the specimen holder will of course have to take into consideration the specimen that will be irradiated.

Figure 3:
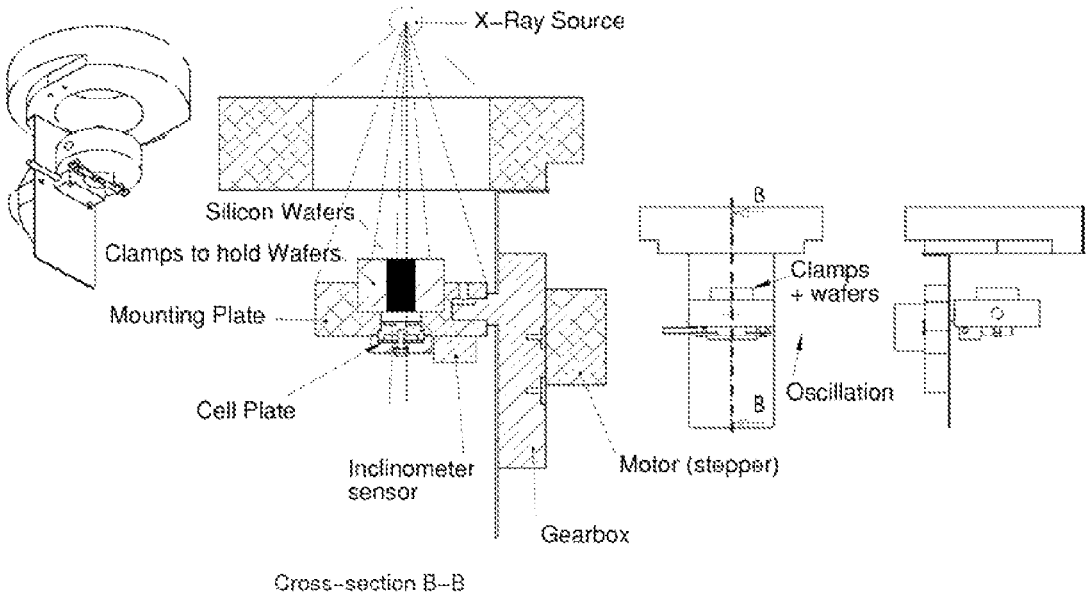
FIG. 3. Diagram of a collimator holder that includes a motorized alignment apparatus and a specimen holder that rotates together with the collimator. Several views of this example are presented from left to right: a three-dimensional view; then a cross-section along line B-B; then a view from the front indicating the line B-B; and then a view from the side. The large ring at the top of the collimator holder is used for attachment to the X-ray tube.
Figure 4:
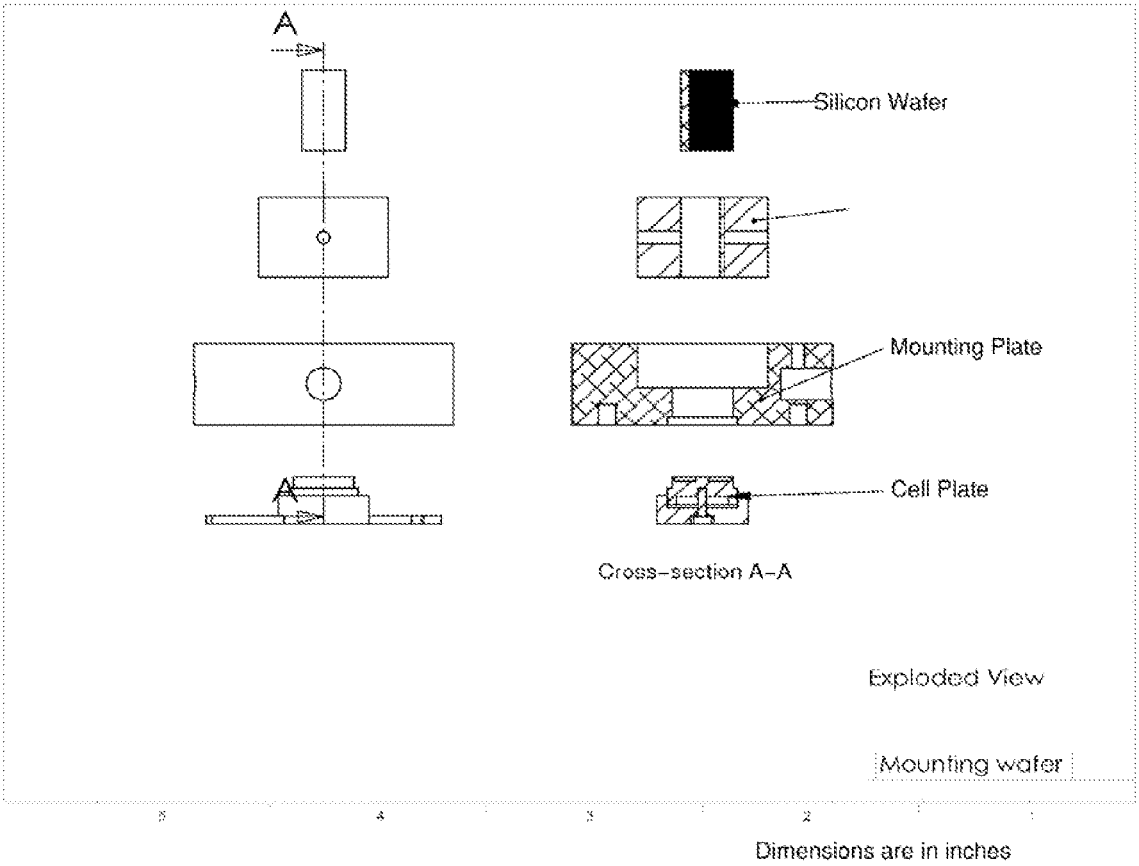
FIG. 4. Higher magnification diagram of the stacked silicon wafers (collimator), the clamps holding the silicon wafers, the mounting plate holding the clamps and the specimen holder (cell plate), where the specimen, such as cells on a coverslip, can be placed. Note that this is an exploded view to show more clearly each component. On the right a cross-section along line A-A is presented.

In some embodiments, a microcollimator holder that includes a motorized alignment apparatus and a specimen holder is shown in FIG. 3 and FIG. 4. This example should not be considered limiting, since many different designs that achieve the same goals are possible.

In some embodiments, the present invention provides for a collimator allowing a specimen to be exposed to an X-ray field, wherein the X-ray field is in the submicrometer to micrometer range, wherein said collimator is comprised of at least 2 plates made of X-ray absorbing material that are stacked against each other and wherein said plates have one or more grooves on their surfaces, through which X-rays can penetrate to produce the X-ray field or fields, whose smallest dimension is in the submicrometer to micrometer range. In some embodiments, the present invention provides a collimator for exposing a specimen to an X-ray field, wherein the X-ray field is in the submicrometer to micrometer range. In some embodiments, the collimator comprises a first structure and a second structure. In some embodiments, the structure is a plate. The shape of the plate can be any shape that allows the grooves to come in contact with a planar surface of another structure to form a channel. For example, the shape of the structure can be, but is not limited to a square, rectangular, circular, oval, hexagon, pentagon, or any other suitable geometric shape, and the like.

In some embodiments, the collimator comprises a first plate having a first planar surface and a second planar surface, wherein the first planar surface comprises one or more grooves. In some embodiments, the collimator comprises a second plate having a first planar surface and a second planar surface, wherein the first planar surface on the second plate optionally comprises one or more grooves. In some embodiments, the present invention provides for a collimator wherein the first planar surface of the first plate is in contact with the second planar surface of the second plate such that the second plate covers over the one or more grooves on first plate. In some embodiments, the collimator comprises more than two structures, such as, but not limited to 3, 4, 5, 6, 7, 8, 9, or 10. In some embodiments, the collimator comprises less than 20 structures. In some embodiments, the structures that can be used in the collimator comprise a first planar and a second planar surface, wherein the first planar surface can comprise one or more grooves.

In some embodiments, the structures are in contact with one another where the edges of the structures are flush or blunt with one another. In some embodiments, the structures in contact with one another are not flush or blunt with one another, wherein the edge of one plate overhangs the edge of another structure.

In some embodiments, the collimator comprises plates through which X-rays 30 can penetrate to produce a X-ray field or fields, wherein plate comprises a groove having a smallest dimension that is in the submicrometer to micrometer range.

In some embodiments, the plates comprise 1, 2, 3, 4, 5, 6, 7, 8, 9, 10, 1-10, I-20, 1-30 grooves. In some embodiments, the plates comprises less than 10 grooves.

In some embodiments, the grooves are or are about 0.5-100, 0.5-50, 0.5-10, 0.5-2, 2-10, 2-50, 0.5, 1, 2, 10, or 50 micrometers in depth. In some embodiments, the grooves are or are about 0.5 micrometers to 3 millimeters in width. In some embodiments, however, the depth is the smaller than the width and in some embodiments, the width is smaller than the depth. In some embodiments, the channel or groove is perpendicular to one edge and/or parallel to another. In some embodiments, the channel or groove is straight. In some embodiments, the grooves are continuous through the structure such that when a channel is formed the channel extends through the structure and the channel is open on both ends. The length of the channel can be any length allowing for the collimation of the energy or light source as described herein. In some embodiments, the length of the channel is about 1-2 centimeters long, but can also be about 0.5 to 5 centimeters in length.

In some embodiments, the collimator produces an X-ray field that is or is about 0.5-50 micrometers in one dimension and 0.5 micrometers to 3 millimeters in a second dimension. In some embodiments, the collimator produces an X-ray field that is or is about 0.5-10 micrometers in one dimension and 0.5 micrometers to 3 millimeters in a second dimension. In some embodiments, the collimator produces an X-ray field that is or is about 0.5-2 micrometers in one dimension and 0.5 micrometers to 3 millimeters in a second dimension.

In some embodiments, when one or more plates are stacked the grooves will form a channel when contacted with a second plate that has a smooth surface. In some embodiments, the channels are or are about 0.5-50, 0.5-10, 0.5-2 micrometers in depth. In some embodiments, the channels are or are about 0.5 micrometers to 3 millimeters in width. In some embodiments, the collimator comprises or comprises at least 1, 2, 3, 4, 5, 6, 7, 8, 9, 10 channels. In some embodiments, the collimator comprises or comprises about 1-10, 1-20, 1-30, 1-50 channels. In some embodiments, the collimator comprises at least 1 channel but not more than or not more than about 100, 200, or 300 channels.

In some embodiments, the collimator comprises plates that are 1-230 centimeters long and/or 1-2 centimeter wide and/or 25-400 micrometers thick. In some embodiments, the said X-ray absorbing material is Silicon. In some embodiments, the X-ray absorbing material is a semiconducting material (such as, but not limited to, In, Ga, or Ge), a ceramic material, a metallic material, a semi-metal, an alloy, a glass or combinations thereof. In some embodiments, the structures are made of S or gallenium arsenidei or other semiconducting material (such as, but not limited to, In, Ga, or Ge), a ceramic material, a metallic material, a semi-metal, an alloy, a glass or combinations thereof.

In some embodiments, the plates are coated with a Si02 surface layer. In some embodiments, the plates coated with a Si02 surface layer are etched resulting in grooves, through which the X-rays penetrate through the collimator.

In some embodiments, the collimator comprises more than one plate with at least one groove and are stacked against each other to produce multiple X-ray fields. In some embodiments the collimator comprises or comprises about 1, 2, 3, 4, 5, 6, 7, 8, 9, or 10 plates with at least one groove each. In some embodiments the collimator comprises 1-10, 1-20, 1-30, 1-100 plates with at least one groove each.

In some embodiments, the present invention provides for an apparatus comprising a collimator holder and a collimator, wherein the holder comprises a first holder plate and a second holder plate. In some embodiments, the apparatus comprises a specimen holder. In some embodiments, the apparatus comprises a third and fourth holder plates that can exert pressure on the first and second plate so that the collimator can be put under pressure In some embodiments, the apparatus comprises an alignment apparatus. In some embodiments, the alignment apparatus rotates the holder along an axis that is perpendicular to an X-ray beam axis. In some embodiments, the alignment apparatus rotates the holder perpendicular to the shortest edge of the produced X-ray field. In some embodiments, the alignment apparatus comprises a motor. In some embodiments, the apparatus comprises an X-ray source, UV-source, infrared source, visible light source, or other radiation or light source.

Example

Figure 5:
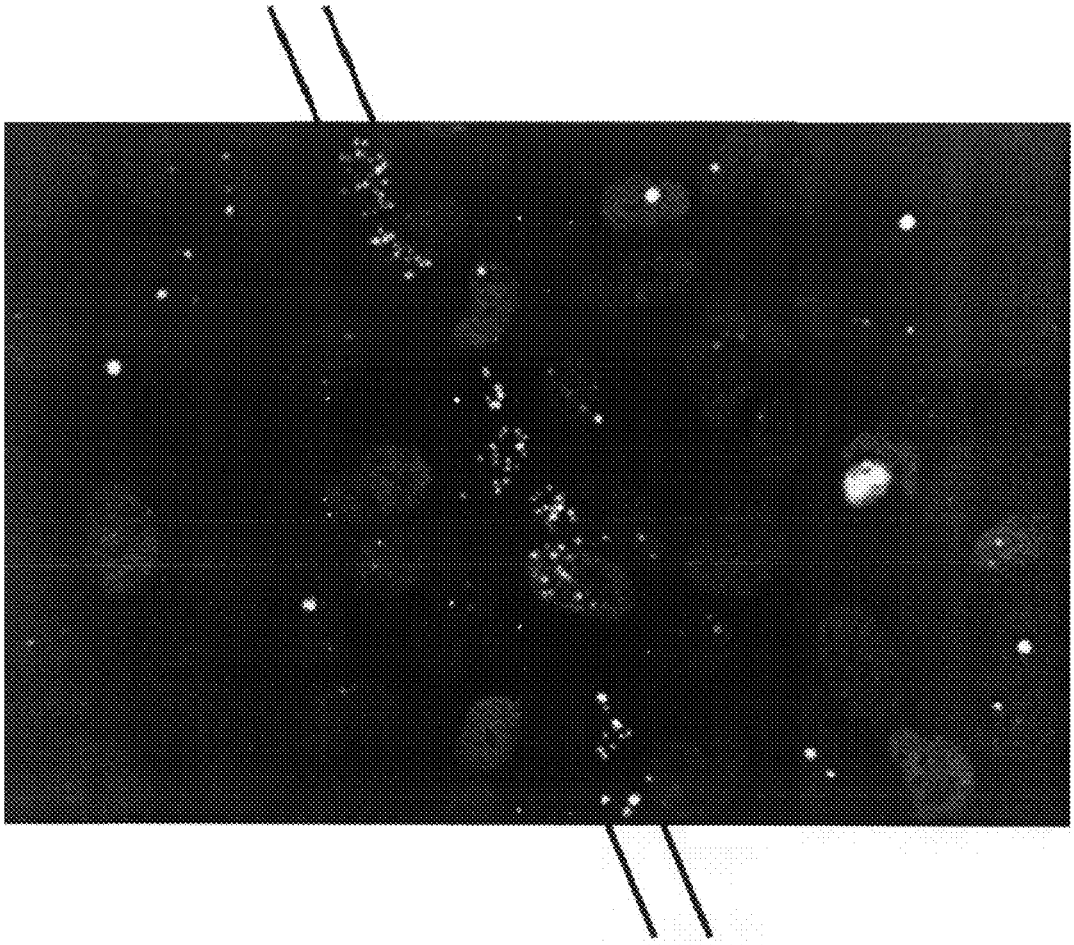
FIG. 5. Example of cells irradiated using the collimator, whose design is shown in FIG. 3. The width of the irradiation stripes is 2 micrometers. The parts of the cell nuclei exposed to X-rays are identified by immunofluorescence for the protein 53BP1, a protein that localizes to sites in the nucleus with DNA double strand breaks. Some fraction of 53BP1 protein remains diffusely nuclear and this allows the nuclei of the cells to be visualized. The lines above and below the image show the approximate boundaries of the irradiated stripe. The cells were examined 1 hour after irradiation during which time cells may have migrated on the tissue culture dish, which may explain why the irradiated stripe is not a perfect line.

To demonstrate whether the collimator would perform as expected, we cultured human U20S osteosarcoma cells on a 12 mm diameter coverslip. Once the cells were almost confluent, we placed the coverslip on the cell plate of the collimator holder and attached the entire collimator to the X-ray tube of the XRAD320 irradiator (manufactured by Precision X-Ray, Inc., North Branford, Conn., USA). The cells were irradiated with a voltage setting of 20,000 Volts and current setting of 25 milliAmps for a total exposure time of 5 minutes. During this time the collimator holder rotated over a range of 5 degrees at a speed of 1 degree per minute. During this rotation the X-rays would be aligned with the collimator, leading to exposure of the cells. Immediately after irradiation the cells were returned to the tissue culture incubator. They were fixed one hour later and processed for immunofluorescence to detect 53BP1, as previously described (Schultz L B, Chehab N H, Malikzay A, Halazonetis T D. p53 binding protein 1 (53BP1) is an early participant in the cellular response to DNA double-strand breaks. *J. Cell Biol.* 2000; 151: 1381-90). 53BP1 is a protein that gets recruited to sites of DNA double-strand breaks; its intracellular localization can therefore serve as a marker of irradiated stripes Indeed, the immunofluorescence analysis indicated the presence of an irradiated stripe about 2 micrometers wide (FIG. 5). The collimator used in this example contained Si chips coated with a 2 micrometer Si02 thin-film, which was etched to produce grooves that were 2 micrometers deep and 1 mm wide. Microfabrication was performed using the 3 steps described herein: photolithography, etching and dicing, resulting in Si chips with dimensions of 1 cm×2 cm×380 micrometers. About 25 such Si chips were stacked and placed in a holder. The holder was part of an apparatus that included a motorized alignment module and a cell holder. A diagram of the entire apparatus, including the collimator is shown in FIGS. 3 and 4.

The disclosures of each and every patent, patent application, publication, and accession number cited herein are hereby incorporated herein by reference in their entirety.

While this invention has been disclosed with reference to specific embodiments, it is apparent that other embodiments and variations of this invention may be devised by others skilled in the art without departing from the true spirit and scope of the invention.

The appended claims are intended to be construed to include all such embodiments and equivalent variations.

What is claimed:

1. A collimator for exposing a specimen to an X-ray field, wherein the X-ray field is in the submicrometer to micrometer range, comprising:

a first structure comprising a first planar surface and a second planar surface, wherein said first planar surface comprises one or more grooves; and a second structure having a first planar surface and a second planar surface, wherein said first planar surface on said second structure optionally comprises one or more grooves;

wherein said first planar surface of said first structure is in contact with said second planar surface of said second structure such that said second structure covers over the one or more grooves on said first structure through which X-rays penetrate to produce the X-ray field or fields, wherein the groove has a smallest dimension that is in the submicrometer to micrometer range.

2. The collimator of claim 1, wherein the X-ray fields are 0.5-50 micrometers in one dimension and 0.5 micrometers to 3 millimeters in the other direction.

3. The collimator of claim 1, wherein the X-ray fields are 0.5-10 micrometers in one dimension and 0.5 micrometers to 3 millimeters in the other direction.

4. The collimator of claim 1, wherein the X-ray fields are 0.5-2 micrometers in one dimension and 0.5 micrometers to 3 millimeters in the other direction.

5. The collimator of claim 1, wherein said structures are 1-2 centimeters long, 1-2 centimeter wide and 25-400 micrometers thick.

6. The collimator of claim 1 wherein said structure is Silicon.

7. The collimator of claim 1 wherein said structure is gallium arsenide.

8. The collimator of claim 1 wherein said structure is a semiconducting material, a ceramic material, a metallic material, a semi-metal, an alloy, a glass or combinations thereof.

9. The collimator of claim 1 wherein said structures are coated with a $SiO_2$ surface layer, whose etching results in the grooves, through which the X-rays penetrate through the collimator.

10. The collimator of claim 1 wherein at least two plates with grooves are stacked against each other to produce multiple X-ray fields.

11. The collimator of claim 1 further comprising a third structure comprising a first planar surface and a second planar surface, wherein said first planar surface of said third structure optionally comprises one or more grooves; wherein said second structure of said third plate is in contact with said first planar surface of said second structure.

12. The collimator of claim 1, wherein said one or more grooves of each structure is about 0.5-100, 0.5-50, 0.5-10, or 0.5-2 micrometers in depth.

13. The collimator of claim 1, wherein said one or more grooves of each structure is about 0.5 micrometers to 3 millimeters in width.

14. An apparatus comprising a collimator holder and a collimator of claim 1, wherein said holder comprises a first plate and a second plate.

15. The apparatus of claim 14, wherein said collimator holder further comprises a specimen holder.

16. The apparatus of claim 14, wherein the said first and second plate of said collimator holder are contained within a second holder wherein said second holder comprises a third plate and fourth plate, wherein said third and fourth plate comprises a force member allowing the first and second plate to be under pressure.

17. The apparatus of claim 14, further comprising an alignment apparatus.

18. The apparatus of claim 17, wherein said alignment apparatus rotates said holder along an axis that is perpendicular to an X-ray beam axis.

19. The apparatus of claim 17, wherein said alignment apparatus rotates said holder perpendicular to a shortest edge of the produced X-ray field.

20. The apparatus of claim 17, wherein said alignment apparatus comprises a motor.

21. The apparatus of claim 14 further comprising an X-ray source.

22. The collimator of claim 1, wherein said one or more grooves of each structure is 0.5-100 micrometers in depth.

23. The collimator of claim 1, wherein said one or more grooves of each structure is 0.5-50 micrometers in depth.

24. The collimator of claim 1, wherein said one or more grooves of each structure is 0.5-10 micrometers in depth.

25. The collimator of claim 1, wherein said one or more grooves of each structure is 0.5-2 micrometers in depth.

* * * * *